US009377018B2

(12) United States Patent
Mangiagli

(10) Patent No.: US 9,377,018 B2
(45) Date of Patent: Jun. 28, 2016

(54) ELECTRONIC INFINITE STEP CONTROLLER ACTUATOR

(75) Inventor: John Mangiagli, Painted Post, NY (US)

(73) Assignee: Dresser-Rand Company, Olean, NY (US)

( * ) Notice: Subject to any disclaimer, the term of this patent is extended or adjusted under 35 U.S.C. 154(b) by 477 days.

(21) Appl. No.: 14/003,876

(22) PCT Filed: Mar. 7, 2012

(86) PCT No.: PCT/US2012/027952

§ 371 (c)(1),
(2), (4) Date: Feb. 3, 2014

(87) PCT Pub. No.: WO2012/122203

PCT Pub. Date: Sep. 13, 2012

(65) Prior Publication Data

US 2014/0294619 A1 Oct. 2, 2014

Related U.S. Application Data

(60) Provisional application No. 61/451,326, filed on Mar. 10, 2011.

(51) Int. Cl.

| | |
|---|---|
| ***F04B 39/08*** | (2006.01) |
| ***F04B 49/22*** | (2006.01) |
| ***F04B 49/24*** | (2006.01) |
| ***F04B 49/06*** | (2006.01) |

(52) U.S. Cl.

CPC ..... *F04B 49/243* (2013.01); *F04B 39/08* (2013.01); *F04B 49/06* (2013.01)

(58) Field of Classification Search

CPC ..... F04B 39/08; F04B 49/243; F04B 39/1053
USPC ..... 137/565.01, 565.13, 596.18, 625.66, 137/601.13, 869, 885
See application file for complete search history.

(56) References Cited

U.S. PATENT DOCUMENTS

| | | | | | |
|---|---|---|---|---|---|
| 2,245,053 | A * | 6/1941 | Sanders, Jr. | F25B 49/022 | 236/1 E |
| 2,296,304 | A * | 9/1942 | Wolfert | F25B 49/022 | 417/298 |
| 2,626,100 | A * | 1/1953 | McIntyre | F04B 41/02 | 303/11 |
| 2,961,148 | A * | 11/1960 | Courtney, Jr. | F25B 49/022 | 417/282 |
| 2,991,924 | A * | 7/1961 | Ramsay | F04B 39/08 | 417/281 |
| 5,833,209 | A * | 11/1998 | Steinruck | F01L 9/02 | 251/47 |
| 7,331,767 | B2 * | 2/2008 | Spiegl | F04B 39/08 | 417/298 |
| 8,500,420 | B2 * | 8/2013 | Spiegl | F04B 39/08 | 137/516.23 |
| 2010/0086415 | A1 * | 4/2010 | Spiegl | F04B 49/243 | 417/53 |
| 2012/0207623 | A1 * | 8/2012 | Allenspach | F04B 39/08 | 417/53 |

* cited by examiner

*Primary Examiner* — Peter J Bertheaud

(57) ABSTRACT

An unloader assembly and method for unloading a compressor, with the unloader assembly including one or more fingers configured to engage one or more valve elements of a suction valve of the compressor. The unloader assembly also includes a biasing member coupled to the one or more fingers and configured to bias the one or more fingers downward such that the one or more fingers follow the one or more valve elements, and an actuating rod coupled to the one or more fingers and extending longitudinally therefrom. The unloader assembly further includes a first reservoir containing a smart fluid and adapted to receive the actuating rod, and a coil disposed at least one of proximal to and within the first reservoir, with the coil being configured to produce a field when an electrical current is supplied to the coil, to change one or more viscoelastic properties of the smart fluid.

19 Claims, 4 Drawing Sheets

ELECTRONIC INFINITE STEP CONTROLLER ACTUATOR

BACKGROUND

The present application is a national stage application of PCT Pat. App. No. PCT/US2012/027952, filed Mar. 7, 2012, which claims priority to U.S. Provisional Patent Application having Ser. No. 61/451,326, which was filed Mar. 10, 2011. These priority applications are incorporated by reference in their entirety into the present application, to the extent that these priority applications are not inconsistent with the present application.

Compressor unloader valves, also known as "unloaders," are often used in reciprocating compressors to optimize compressor efficiency at various throughput rates. Generally, a reciprocating compressor includes a piston, which moves back-and-forth in a chamber. The piston has a compression stroke, during which the piston compresses a process gas between itself and an end of the chamber, and a return stroke, during which the piston is drawn back to bottom dead center to begin the next compression stroke. Reciprocating compressors also include an inlet line through which the process gas to be compressed is received into the chamber, and a discharge line through which the process gas is expelled after compression. A discharge valve and a suction valve are positioned in the suction and discharge positions of the cylinder, respectively. The discharge and suction valves are typically check valves; thus, in normal operation, the discharge valve allows compressed gas to exit the compressor chamber, but prohibits it from flowing back into the chamber. Similarly, the suction valve allows the process gas into the chamber, but prevents it from flowing back out.

To control the amount of gas compressed, and thus provide optimum compression for a given throughput, unloaders are often used. One type of unloader operates by holding the suction valve elements of the suction valve open after the piston arrives at bottom dead center and begins the compression stroke. Thus, instead of being compressed, the process gas is allowed to flow past the open suction valve elements and back into the inlet line until the desired amount of gas to be compressed for the stroke remains in the cylinder. The unloader then releases the suction valve elements, allowing them to close.

Accordingly, infinite step controllers (ISCs) may be used to provide variable valve opening duration during the return and/or compression stroke. One type of ISC employs fingers, which are attached to an actuator piston. The fingers engage the suction valve elements, preventing them from closing. The actuator piston movement is controlled by a hydraulics system to quickly achieve optimum unloader position. Such hydraulics, while proven reliable and acceptable in many applications, increase the complexity of the ISC system. Accordingly, such hydraulically-actuated ISCs can lead to increased operating and maintenance costs. What is needed, therefore, is a system and method for providing a reliable ISC that is capable of moving rapidly and with precision to provide a range of suction valve positions.

SUMMARY

Embodiments of the disclosure may provide an exemplary unloader assembly for a compressor. The unloader assembly may include one or more fingers configured to engage one or more valve elements of a suction valve of the compressor, with the one or more valve elements being configured to move downward from a closed position to an open position and being biased toward the closed position. The unloader assembly may also include a biasing member coupled to the one or more fingers and configured to bias the one or more fingers downward such that the one or more fingers follow the one or more valve elements, and an actuating rod coupled to the one or more fingers and extending longitudinally therefrom. The unloader assembly may further include a first reservoir containing a smart fluid and adapted to receive the actuating rod, and a coil disposed at least one of proximal to and within the first reservoir, with the coil being configured to produce a field when an electrical current is supplied to the coil, to change one or more viscoelastic properties of the smart fluid.

Embodiments of the disclosure may also provide an exemplary method for unloading a suction valve of a compressor. The method may include engaging one or more valve elements of the suction valve with an unloader assembly, and biasing the unloader assembly toward the one or more valve elements such that the unloader assembly and the one or more valve elements translate proportionally to one another. The method may also include resisting movement of the unloader assembly to delay the one or more valve elements from closing by supplying an electrical current to a coil disposed at least one of proximal to and within a first reservoir containing a smart fluid, such that one or more viscoelastic properties of the smart fluid change, the unloader assembly being partially disposed in the first reservoir.

Embodiments of the disclosure may also provide an exemplary apparatus for unloading a suction valve of a reciprocating compressor. The apparatus may include a first reservoir containing a smart fluid including electrorheological fluid, magnetorheological fluid, or both. The apparatus may also include one or more coils disposed proximal the smart fluid and coupled to a source of electrical current, such that when an electrical current is provided to the one or more coils, the smart fluid changes from a relatively low-viscosity fluid to a relatively high-viscosity gel, a viscoelastic solid, or a combination thereof. The apparatus may further include a housing disposed between the first reservoir and the suction valve and extending longitudinally therebetween, and one or more seals disposed between the housing and the first reservoir. The apparatus may also include an actuating rod extending from within the first reservoir and through an aperture defined in the housing, and into the housing, with the actuating rod being configured to translate longitudinally with respect to the first reservoir and the housing. The apparatus may further include a plunger plate coupled to the actuating rod and configured to translate longitudinally therewith, and one or more fingers coupled to the plunger plate, extending longitudinally therefrom, and configured to translate longitudinally therewith, the one or more fingers being further configured to be received into one or more ports of the suction valve and to engage one or more valve elements thereof, the one or more valve elements being biased toward a closed position and configured to move toward an open position in the presence of a pressure differential. The apparatus may also include a biasing member coupled to the plunger plate and configured to bias the plunger plate toward the one or more valve elements such that the fingers follow the movement of the one or more valve elements, and a pressure balance line extending between the housing and the first reservoir and configured to communicate the pressure from the housing to the first reservoir. The apparatus may also include an ISC controller communicably coupled to the source of electrical current, with the ISC controller being configured to send electrical current from the source of electrical current to the coils, such that the smart fluid resists the movement of the actuating rod.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
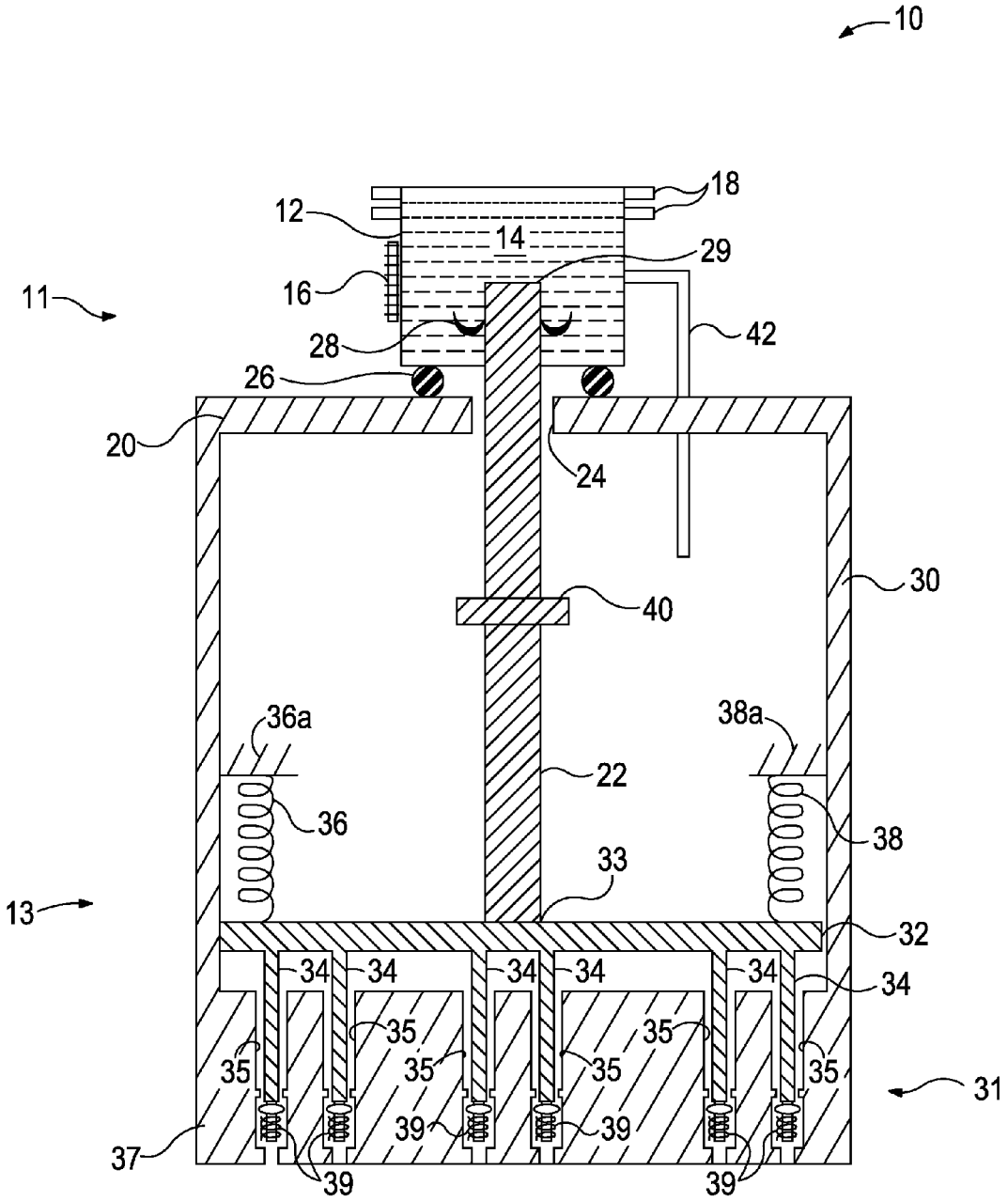
FIG. 1 illustrates a diagrammatic view of an ISC-unloader assembly, in accordance with one or more aspects of the disclosure.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Moreover, as they are used herein, terms such as "up" and "down"; "above" and "below"; "upon"; "top" and "bottom"; "upward" and "downward"; and others indicative of position and/or direction refer to relative positions between structures and are not intended to denote a particular spatial orientation. It will thus be appreciated that embodiments of the following disclosure may be equally effective regardless of whether oriented as shown or rotated, flipped, upside-down, etc. from what is shown in the Figures of this disclosure.

FIG. 1 illustrates a simplified diagrammatic view of an exemplary ISC-unloader assembly 10 for a reciprocating compressor, according to one or more embodiments described. The ISC-unloader assembly 10 generally includes an ISC actuator 11 and an unloader assembly 13. The ISC actuator 11 includes a reservoir 12, in which smart fluid 14 is contained. The term "smart fluid" is generally defined herein to mean any composition that may be activated by the application of an electric field or a magnetic field, such that one or more viscoelastic properties of the smart fluid change. For example, one viscoelastic property that may change is the apparent viscosity of the smart fluid. In an embodiment, the smart fluid may normally be a fluidic suspension, which may generally include a liquid and dipolar and/or non-conductive particles, and typically has a relatively low viscosity. Upon activation, the smart fluid may change to a relatively high (in comparison to the fluidic suspension) viscosity gel, a viscoelastic solid, a combination thereof, or the like. In other words, the smart fluid may increase in apparent viscosity, developing a shear yield stress, and/or increasing its shear yield stress, upon activation. Moreover, it will be appreciated that the activation may be a matter of degree, producing a range of activated states, for example, according to the magnitude and/or direction of the field applied. For example, during activation, the apparent viscosity of the smart fluid may be predictably varied by varying the properties of the field applied thereto.

Compositions that are capable of activating in the presence of an electric field are often referred to as "electrorheological fluids." One example, among many contemplated herein, of an electrorheological fluid is found in U.S. Pat. No. 6,352,651, the entirety of which is incorporated herein by reference, to the extent not inconsistent with the present disclosure. Compositions that change in the presence of a magnetic field are often referred to as "magnetorheological fluids." One example, among many contemplated herein, of a magnetorheological fluid is found in U.S. Pat. No. 5,505,880, the entirety of which is incorporated herein by reference, to the extent not inconsistent with this disclosure. It will be appreciated that smart fluids may also include other fluids that activate, consistent with the definition provided above.

The ISC actuator 11 includes one or more electrical coils 16 disposed in close proximity to the reservoir 12. For example, the electrical coils 16 may be disposed in a housing (not shown) adjacent and/or attached to the exterior of the reservoir 12, or may be disposed within the reservoir 12 itself. It will be appreciated that various configurations are contemplated herein in which the coils 16 are positioned such that an electric and/or magnetic field created by running current through the coils 16 acts on the smart fluid 14 to trigger the desired viscosity increase and/or change from a fluidic suspension to a gel, a viscoelastic solid, or a combination thereof.

Moreover, varying the electric current supplied to the coils 16 may enable a predictable varying of the viscoelastic properties of the smart fluid 14. Indeed, varying the electric current supplied to the coils 16 may vary the magnitude of the field created by the coils 16 and applied to the smart fluid 14. In the presence of such a varying field, the viscoelastic properties of the smart fluid 14 may vary predictably. As such, the viscoelastic properties of the smart fluid 14 may be determined and controlled as a function of the current supplied to the coils 16.

Cooling fins 18 may also be coupled to the exterior and/or interior of the reservoir 12 using any suitable connection process. The cooling fins 18 may be disposed around the outside of the reservoir 12 and extend outward therefrom to increase the surface area thereof for greater heat exchange. In other embodiments, the cooling fins 18 may be disposed and extend in any direction suitable. Various devices to assist heat removal, such as a fan (not shown) or more complex cooling systems, may be employed with or in lieu of the cooling fins 18.

The ISC-unloader assembly 10 may further include a cylindrical housing 30, which may include a valve cover 20 at the top end thereof. Although illustrated as cylindrical, it will be appreciated that the housing 30 may be any suitable shape. In an embodiment, the reservoir 12 may be disposed on the valve cover 20. An actuating rod 22 may extend from within the reservoir 12 through the valve cover 20 via an aperture 24 defined in the valve cover 20. A first sealing element 26, for example, one or more o-rings, may be disposed between the reservoir 12 and the valve cover 20 to avoid pressure losses and/or leakage between the valve cover 20 and the atmosphere. It will be appreciated that the first sealing element 26 may be or include various other types of seals without departing from the scope of the disclosure. Further, the ISC actuator 11 may include a second sealing element 28 disposed around the actuator rod 22, proximal the top end 29 thereof, and located within the reservoir 12. The second sealing element 28 may keep the smart fluid 14 from leaking out of the reservoir 12 along the actuating rod 22. The second sealing element 28 may be or include one or more of any suitable type of seal, for example, a lip seal. However, it will be appreciated that the second sealing element 28 may be or include various other types of seals, or may be omitted in some embodiments.

The housing 30 may extend longitudinally from the valve cover 20 toward a suction valve 31 of a reciprocating compressor (not shown). In an embodiment, the actuating rod 22 extends longitudinally in the housing 30, from the valve cover 20 toward the suction valve 31. Further, although not shown, the housing 30 may define one or more lateral openings, which connect the interior of the housing 30 to the exterior thereof. The housing 30 may thus be coupled to a suction line (not shown) of the reciprocating compressor and the lateral openings may provide a flowpath through the housing 30 between the suction line and the suction valve 31.

The unloader assembly 13 may also include a plunger plate 32 coupled to a lower end 33 of the actuating rod 22. Further, the unloader assembly 13 may include one or more fingers 34 coupled to the plunger plate 32 and extending longitudinally therefrom toward the suction valve 31. The fingers 34 may be attached to the plunger plate 32 in any suitable manner, such as by welding, brazing, fastening, or the like, or may be integrally-formed therewith, such as by casting or milling from a blank. In one example, the fingers 34 may be attached as described in U.S. Pat. No. 5,642,753, commonly-assigned to Dresser-Rand Co., which is incorporated herein by reference in its entirety, to the extent not inconsistent with this disclosure. In other embodiments, the plunger plate 32 may be omitted, with the one or more fingers 34 coupled directly to the actuating rod 22.

The fingers 34 may be received into ports 35 defined in a valve seat 37 of the suction valve 31. The fingers 34 are capable of translating up-and-down and engaging the top of valve elements 39 of the suction valve 31. For example, the fingers 34 may operate in the unloader assembly 13 as described in one or both of U.S. Pat. No. 5,025,830. and U.S. Patent Application Publication No. 2009/0238699, both commonly-assigned to Dresser-Rand Co., the entirety of both being incorporated herein by reference, to the extent not inconsistent with this disclosure. It will be appreciated that although the fingers 14 are shown as cylinders, they may be any desirable shape without departing from the scope of the disclosure.

The valve elements 39 may be configured to close the suction valve 31 when the valve elements 39 reach their upper-most position, but simultaneously enable flow at all other points, with the allowed flow rate therethrough increasing as the valve elements 39 are lowered. Further, the valve elements 39 may be biased upwards by any suitable biasing device, such as a spring. Accordingly, the valve elements 39 are configured to close the suction valve 31 in the absence of any external force and open the suction valve 31 only when the pressure in the suction line (not shown) to which the suction valve 31 is coupled is greater than the pressure in the chamber (not shown) of the reciprocating compressor to which the suction valve 31 is also coupled.

The unloader assembly 13 may also include one or more biasing members, for example, coiled springs (two are shown: 36, 38) coupled to the plunger plate 32. The springs 36, 38 may be configured to bias the plunger plate 32, and thus the fingers 34 and actuating rod 22, downward, i.e., opposite to the direction in which the valve elements 39 are biased. As shown, the springs 36, 38 may be disposed above the plunger plate 32 such that the springs 36, 38 are compressed against structures 36*a*, 38*a*, respectively, which are stationary relative to the housing 30, by upward movement of the plunger plate 32. The structures 36*a*, 38*a*. are illustrated conceptually and in various embodiments may be posts fixed to the valve seat 37 and extending through the plunger plate 32, or may be one or more blocks, disks, armatures, etc., coupled to the valve seat 37 and/or the housing 30, or may be omitted, with the springs 36, 38 instead bearing on the valve cover 20. In other embodiments, the springs 36, 38 may be positioned below the plunger plate 32 such that the springs 36, 38 are extended beyond their natural position by the same upward movement. In still other embodiments, other types of resilient biasing structures or devices may be used in addition to or in lieu of the springs 36, 38. The springs 36, 38 bias the fingers 34 against the valve elements 39, such that the fingers 34, plunger plate 32, and actuating rod 22 follow the valve elements 39 as they move up and down.

The actuating rod 22 may also have a shoulder 40. The shoulder 40 has a greater radius than the aperture 24 and may be positioned such that the shoulder 40 engages the bottom of the valve cover 20 when the plunger plate 32 reaches the top end of its stroke. In other embodiments, the shoulder 40 may be positioned below this position, such that when the plunger plate 32 is at the top of its stroke, the shoulder 40 is spaced apart from the valve cover 20. The shoulder 40 is configured to prevent off-design conditions from propelling the actuating rod 40 beyond the desired upper end range, avoiding the potential for damage to the ISC-unloader assembly 10.

The ISC-unloader assembly 10 may also include a pressure balance line 42. The pressure balance line 42 connects the interior of the housing 30 to the reservoir 12. Accordingly, the pressure balance line 42 may reference the pressure in the reservoir 12 to the pressure in the housing 30, thereby avoiding or at least reducing a pressure differential on the actuating rod 22, which would otherwise tend to draw the actuating rod 22 upwards.

In exemplary operation, the ISC-unloader assembly 10 provides control over the position of a suction valve 31, without requiring complex hydraulic assemblies to support the operation. During the return stroke of the compressor piston, the valve elements 39 are drawn downwards to admit process gas into the compressor chamber. The springs 36, 38 bias the plunger plate 32 downward, thereby urging the plunger plate 32 and the attached fingers 34 to follow the valve elements 39 downward through the ports 35. Although the compressor described herein is described as compressing "process gas," it will be appreciated that such process gas may include small amounts of liquid and/or solid particulates, without departing from the scope of this disclosure.

Once the compressor piston reaches bottom dead center, the pressure differential holding the valve elements 39 downward is released, as the pressure within the chamber is the same as the pressure in the suction line of the compressor. Accordingly, the valve elements 39 seek to move upwards to close the suction valve 31, according to its normal check valve function. However, in many cases, as described above, it is desirable to hold the suction valve 31 open to prevent process gas from being compressed during a portion of the compression stroke of the compressor.

To temporarily prevent, or at least slow, the rise of the valve elements 39 toward the closed position, current is supplied to the coils 16, thereby causing loose particles in the smart fluid 14 to rapidly align into fibrous structures, increasing the viscosity of the smart fluid 14 and/or changing the smart fluid 14 to a viscoelastic solid. Unlike in the deactivated, fluidic state, the smart fluid in this gel or viscoelastic solid form may have a shear yield point, and thus resists the upward movement of the actuating rod 22, thereby resisting or otherwise slowing the movement of the fingers 34. Since the fingers 34, biased by the springs 36, 38, follow the top of the valve elements 39, the upward movement of the valve elements 39 is also stopped, or at least resisted and slowed. As such, the ISC-unloader assembly 10 temporarily holds the valve elements 39 away from their upper-most and closed position, enabling free flow from the compressor chamber out through the suction valve 31. When it is desired to recommence normal operation of the suction valve 31, the current to the coils 16 is discontinued and the smart fluid 14 returns to its relatively low-viscosity, fluidic state. The actuating rod 22 and thus the valve elements 37 are then free to translate up-and-down as normal.

Figure 2:
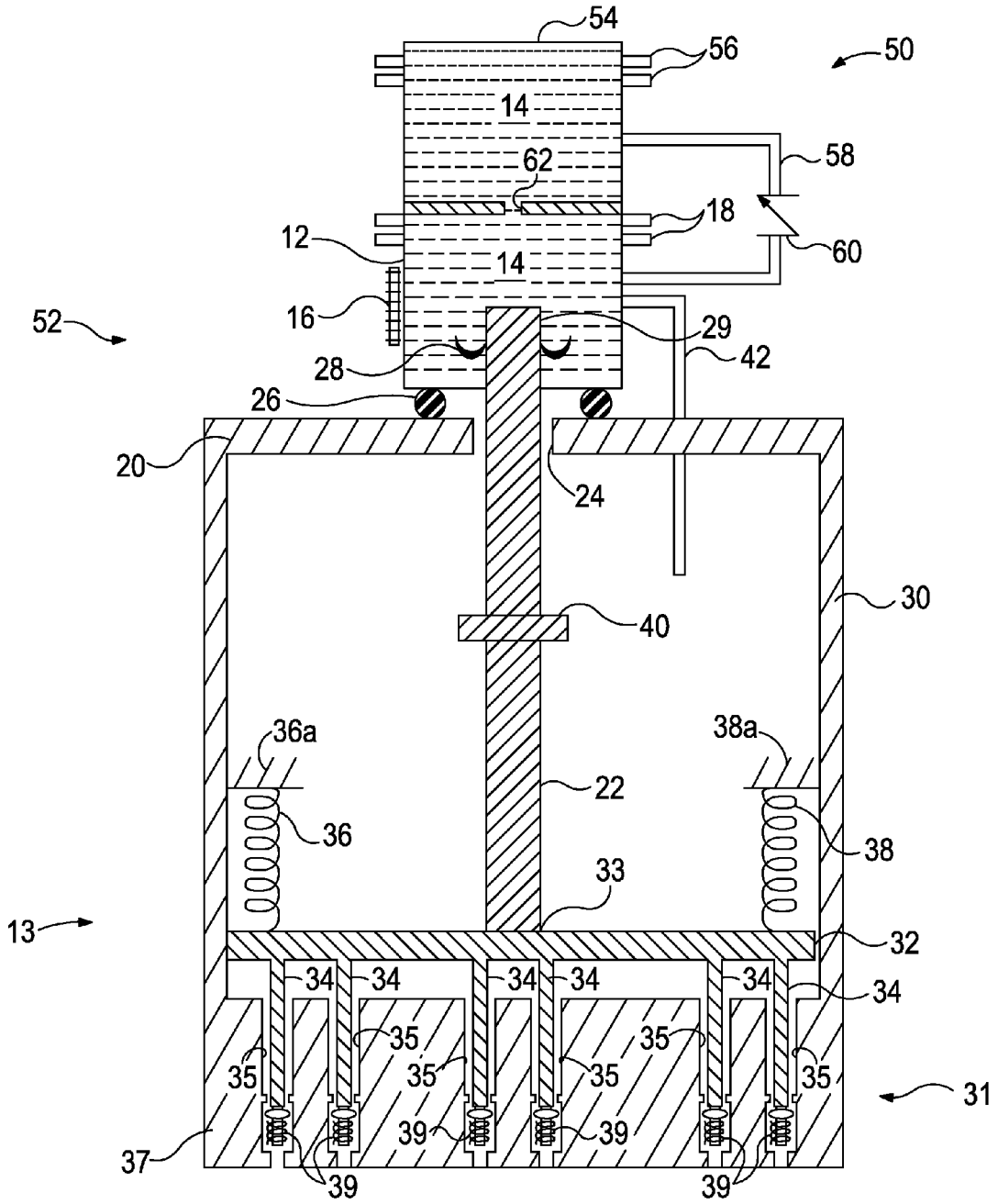
FIG. 2 illustrates a diagrammatic view of another ISC-unloader assembly, in accordance with one or more aspects of the disclosure.

FIG. 2 illustrates a diagrammatic view of another ISC-unloader assembly 50, according to one or more embodiments. The ISC-unloader assembly 50 is similar in many respects to the ISC-unloader assembly 10 shown in FIG. 1 and may operate in a similar manner. Accordingly, ISC-unloader assembly 50 may be best understood with reference to the ISC-unloader assembly 10, where like numerals are used to designate like components. At least one difference found in the ISC-unloader assembly 50 is that it includes an ISC actuator 52 having a second reservoir 54, with the reservoir 12 being referred to as the "first" reservoir 12. Although illustrated in a top-and-bottom configuration, it will be appreciated that the first and second reservoirs 12, 54 may be positioned in any configuration and may or may not be adjacent to each other. A cooling device, which may include cooling fins 56, as shown, may be attached to the second reservoir 54, to aid in the removal of heat from the smart fluid 14. Various embodiments may include one or both of cooling fins 18 and cooling fins 56.

The ISC actuator 54 may further include a circulation line 58 extending between and communicating with the first and second reservoirs 12, 54. A check valve 60 may be coupled to the circulation line 58, such that fluid flow through the circulation line 58 is permitted only from the first reservoir 12 to the second reservoir 54, but not in the reverse direction. Further, the ISC actuator 52 may include a return line 62. In an embodiment, as shown, the return line 62 may be an orifice, which extends between the first and second reservoirs 12, 54. The return line 62 provides a second channel for fluid communication between the first and second reservoirs 12, 54. Further, although not shown, in some embodiments, a check valve may be coupled to, disposed in, or otherwise fluidly communicating with the return line 62, such that fluid flow from the first reservoir 12 to the second reservoir 54 is blocked.

In exemplary operation, the up-and-down movement of the actuating rod 22 caused by the compressor operation heats the smart fluid 14. In some cases, this increased temperature of the smart fluid 14 can be problematic, and may be too great for the cooling fins 18 of the first reservoir 12 to sufficiently remove. In such cases, the two-reservoir embodiment of the ISC actuator 54 may be employed. The two-reservoir ISC actuator 54 uses the up-and-down movement of the actuator rod 22 as a pump. As the actuator rod 22 is received into the first reservoir 12, the volume available for the smart fluid 14 therein is reduced. Accordingly, the fluidic and generally-incompressible smart fluid 14 is propelled through the circulation line 58, past the check valve 60, and into the second reservoir 54.

The second reservoir 54 may contain an additional amount of smart fluid 14, which is cooled by the cooling device 56, and is thermally separated from the heat-inducing actuating rod 22. Accordingly, over a period of time, the heated smart fluid 14 from the first reservoir 12 that is circulated to the second reservoir 54 is cooled in the second reservoir 54, and may settle to the bottom as it cools. Then, on the downstroke of the actuating rod 22, a pressure differential between the first and second reservoirs 12, 54, the smart fluid 14 may be drawn through the return line 62, and back into the first reservoir 14.

Figure 3:
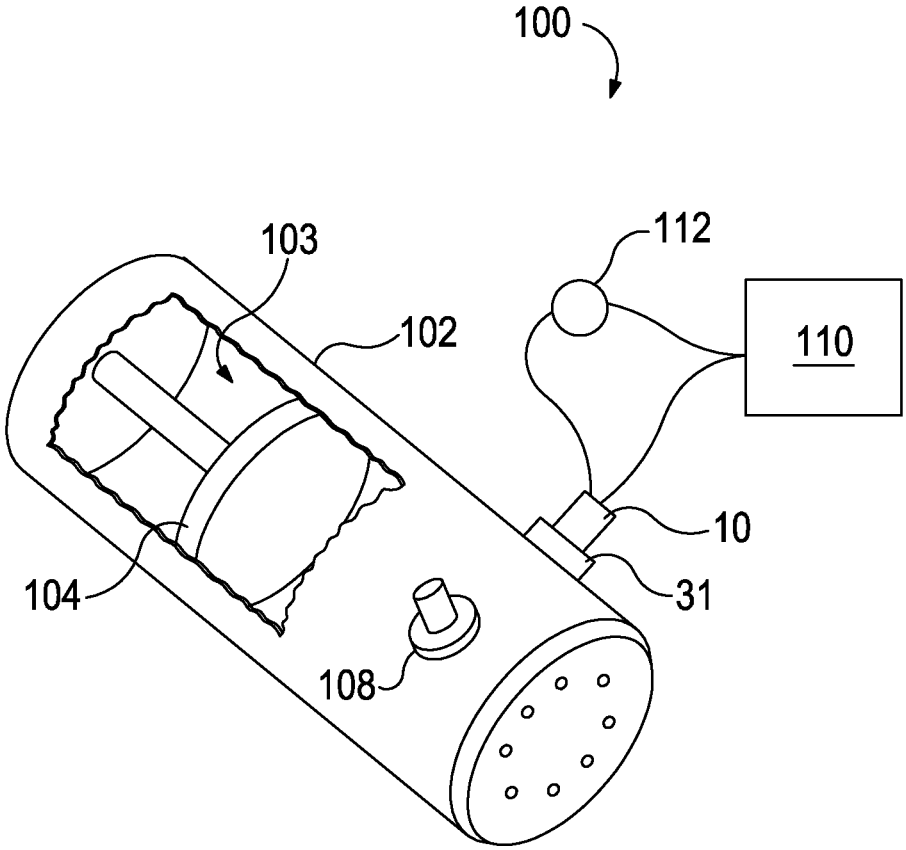
FIG. 3 illustrates a simplified perspective view of a reciprocating compressor, in accordance with one or more aspects of the disclosure.

FIG. 3 illustrates a simplified view of a reciprocating compressor 100 that employs the ISC-unloader assembly 10 or 50, according to one or more embodiments. For ease of description and illustration, reference numeral 10 is hereafter used to denote the ISC-unloader assembly shown in FIG. 3; however, it will be appreciated that either ISC-unloader assembly 10 or 50 may be advantageously employed with the reciprocating compressor 100.

The reciprocating compressor 100 includes a casing 102, which defines a chamber 103, in which a piston 104 is disposed. The reciprocating compressor 100 also includes one or more of the suction valves 31 and one or more discharge valves 108. As shown, the ISC-unloader assembly 10 is connected to the suction valve 31. In embodiments including more than one suction valve, one, some, or all valves may employ the ISC-unloader assembly 10. The operation of the reciprocating compressor 100 is well-known and therefore not described in detail herein.

As shown, the ISC-unloader assembly 10 may be coupled to an ISC controller 110 and to a source of current 112. The ISC controller 110 controls the ISC-unloader assembly 10 to optimize the performance of the reciprocating compressor 100. With additional reference to FIGS. 1 and 2, when it is desired to hold the valve 31 open during the compression stroke of the piston 104, the ISC controller 110 signals the source of current 112 to provide the electrical current to the coils 16. Depending on the type of smart fluid 14, the coils 16 are configured to receive the electrical current and apply an electric or magnetic field to the smart fluid 14, causing the desired viscosity increase thereof. When it is desired to recommence normal operation of the suction valve 31, the ISC controller 110 instructs the source of current 112 to end its supply of current to the coils 16. Accordingly, the ISC controller 110 may be coupled to a variety of sensors within the suction valve 31, the reciprocating compressor 100, upstream thereof, or downstream thereof to determine the optimum timing for unloading the reciprocating compressor 100.

Figure 4:
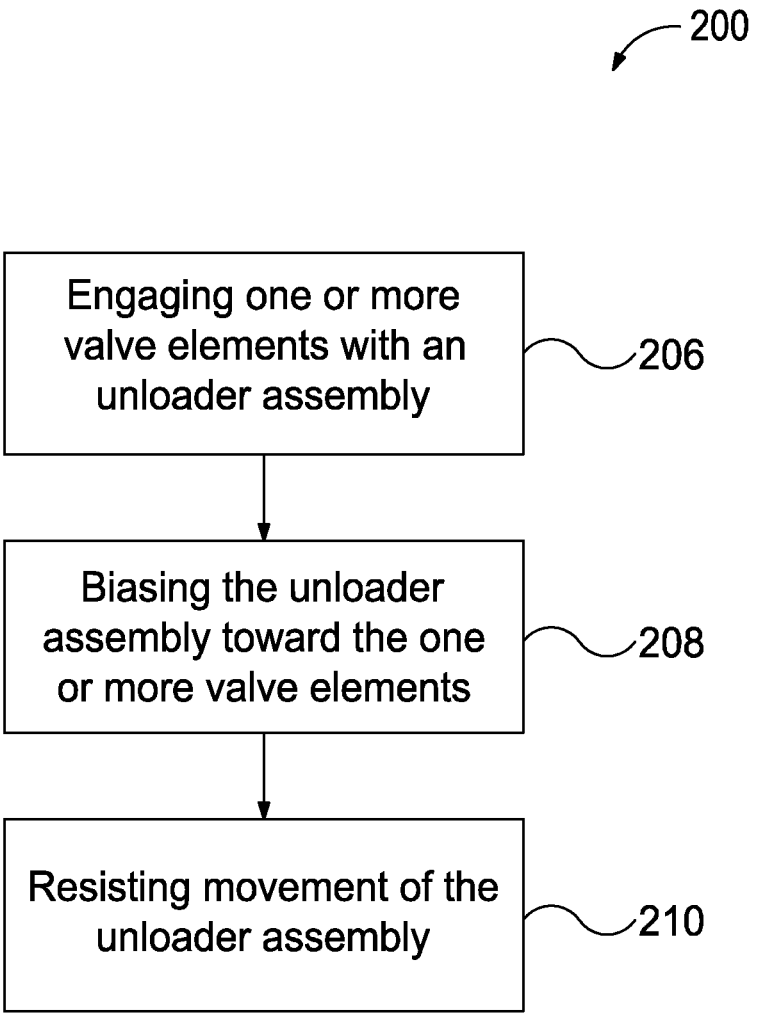
FIG. 4 illustrates a flowchart of a method for actuating an unloader, in accordance with one or more aspects of the disclosure.

FIG. 4 illustrates a flowchart of an exemplary method 200 for unloading a suction valve of a compressor, for example, a reciprocating compressor. The method 200 may proceed by operation of the ISC-unloader assembly 10 (FIG. 1), 50 (FIG. 2), and/or by operation of the reciprocating compressor 100 (FIG. 3). Accordingly, the method 200 may be best understood with reference thereto. The method 200 may include engaging one or more valve elements of the suction valve with an unloader assembly, as at 206. The method 200 may also include biasing the unloader assembly toward the one or more valve elements such that the unloader assembly and the valve elements translate proportionally to one another, as at 208. In an embodiment, the suction valve is a check valve configured to allow process gas to enter a chamber of the compressor from a suction line when the pressure of the process gas in the suction line is greater than the pressure in the chamber. As such, one or more valve elements of the suction valve may be biased closed such that process gas only enters the compressor chamber according to this pressure differential.

The method 200 may also include resisting movement of the unloader assembly and the valve elements, as at 210. Doing so may resist the movement of the valve elements, thereby delaying the closing of the suction valve. To resist the movement of the unloader assembly, as at 210, an electrical current is supplied to a coil disposed at least one of proximal to and within a first reservoir containing smart fluid. Accordingly, the viscosity of the smart fluid increases and/or the smart fluid changes to a viscoelastic solid, with the unloader assembly being partially disposed in the first reservoir.

In one or more embodiments, the unloader assembly used in method 200 may include an actuating rod extending into the first reservoir, a plunger plate coupled to the actuating rod, and one or more fingers extending from the plunger plate. Further, in one or more embodiments, engaging the one or more valve elements, as at 206, may also include engaging the one or more valve elements with an end of the one or more fingers. Additionally, biasing the unloader assembly as at 208 may also include attaching one or more springs to the plunger plate.

In one or more embodiments, the method 200 may further include pumping the smart fluid from the first reservoir to a second reservoir via a circulation line, cooling the smart fluid in the second reservoir, and pumping the smart fluid back to the first reservoir from the second reservoir. Additionally, the method 200 may further include pumping the smart fluid from the first reservoir to the second reservoir by allowing the actuating rod to move upward as the one or more valve elements move toward the closed position, and pumping the smart fluid back to the first reservoir from the second reservoir by allowing the actuating rod to move downward as the one or more valve elements move away from the closed position. In one or more embodiments, the method 200 may also include balancing the pressure between the first reservoir and the suction valve, such as with a pressure balance line, as described above with respect to FIG. 1.

In one or more embodiments, resisting movement of the unloader assembly, as at 210, may include producing an electric field with the coils that acts on the smart fluid, the smart fluid including an electrorheological fluid. Additionally or alternatively, resisting the movement of the unloader assembly as at 210 may include producing a magnetic field that acts on the smart fluid, the smart fluid including magnetorheological fluid. Further, resisting the movement of the unloader assembly as at 210 may include delaying the one or more valve elements movement into the closed position. Moreover, the method 200 may also include removing the resistance to the movement of the unloader assembly by ceasing to supply electrical current to the coils such that the one or more valve elements are free to move to the closed position.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. An unloader assembly for a compressor, comprising:

one or more fingers configured to engage one or more valve elements of a suction valve of the compressor, the one or more valve elements being configured to move downward from a closed position to an open position and being biased toward the closed position;

a biasing member coupled to the one or more fingers and configured to bias the one or more fingers downward such that the one or more fingers follow the one or more valve elements;

an actuating rod coupled to the one or more fingers and extending longitudinally therefrom;

a first reservoir containing a smart fluid and adapted to receive the actuating rod;

a housing in which the one or more fingers and the actuating rod are at least partially disposed;

a pressure balance line extending from within the housing to the first reservoir, such that a pressure in the first reservoir is referenced to a pressure in the housing; and a coil disposed at least one of proximal to and within the first reservoir, the coil being configured to produce a field when an electrical current is supplied to the coil to change one or more viscoelastic properties of the smart fluid.

2. The unloader assembly of claim 1, wherein the one or more viscoelastic properties includes viscosity.

3. The unloader assembly of claim 1, wherein the coil is configured to change the one or more viscoelastic properties of the smart fluid across a range of values by varying the electrical current supplied to the coil.

4. The unloader assembly of claim 1, wherein the field is an electric field and the smart fluid comprises an electrorheological fluid.

5. The unloader assembly of claim 1, wherein the field is a magnetic field and the smart fluid comprises a magnetorheological fluid.

6. The unloader assembly of claim 1, wherein:

the housing defines an aperture therein, the actuating rod being slidably received through the aperture and extending into the first reservoir; and the actuating rod further comprises a shoulder extending outwardly therefrom and being configured to engage the housing to prevent further sliding of the actuating rod through the aperture and into the first reservoir.

7. The unloader assembly of claim 1, further comprising:

a second reservoir also containing the smart fluid;

a circulation line fluidly communicating with the first and second reservoirs, the circulation line being configured to allow the smart fluid to flow from the first reservoir to the second reservoir; and a return line communicating with the first and second reservoirs, the return line being configured to allow the smart fluid to flow from the second reservoir to the first reservoir.

8. The unloader assembly of claim 7, wherein the circulation line and the return line each include at least one of a check valve and an orifice.

9. A method for unloading a suction valve of a compressor, comprising:

engaging one or more valve elements of the suction valve with an unloader assembly;

biasing the unloader assembly toward the one or more valve elements such that the unloader assembly and the one or more valve elements translate proportionally to one another; and resisting movement of the unloader assembly to delay the one or more valve elements from closing by supplying an electrical current to a coil disposed at least one of proximal to and within a first reservoir containing a smart fluid such that one or more viscoelastic properties of the smart fluid change, the unloader assembly being partially disposed in the first reservoir.

10. The method of claim 9, further comprising varying the electrical current supplied to the coil to vary the one or more viscoelastic properties of the smart fluid.

11. The method of claim 9, wherein, when the electrical current is supplied to the coil, at least a portion of the smart fluid changes from a fluidic suspension having a relatively low viscosity to a gel having a relatively high viscosity, a viscoelastic solid, or a combination thereof.

12. The method of claim 9, wherein:

the unloader assembly includes an actuating rod extending into the first reservoir, a plunger plate coupled to the actuating rod, and one or more fingers extending from the plunger plate;

engaging the one or more valve elements comprises engaging the one or more valve elements with an end of the one or more fingers; and biasing the unloader assembly comprises attaching one or more springs to the plunger plate.

13. The method of claim 9, further comprising:

pumping the smart fluid from the first reservoir to a second reservoir via a circulation line;

cooling the smart fluid in the second reservoir; and pumping the smart fluid back to the first reservoir from the second reservoir.

14. The method of claim 13, wherein:

pumping the smart fluid from the first reservoir to the second reservoir comprises allowing the actuating rod to move upward as the one or more valve elements move toward the closed position; and pumping the smart fluid back to the first reservoir from the second reservoir comprises allowing the actuating rod to move downward as the one or more valve elements move away from the closed position.

15. The method of claim 9, further comprising balancing the pressure between the first reservoir and a housing in which the unloader assembly is at least partially disposed.

16. The method of claim 9, wherein resisting movement of the unloader assembly comprises at least one of:

producing an electric field with the coils that acts on the smart fluid, the smart fluid comprising an electrorheological fluid; and producing a magnetic field that acts on the smart fluid, the smart fluid comprising magnetorheological fluid.

17. The method of claim 9, further comprising removing the resistance to the movement of the unloader assembly by ceasing to supply electrical current to the coils such that the one or more valve elements are free to move to the closed position.

18. An apparatus for unloading a suction valve of a reciprocating compressor, comprising:

a first reservoir containing a smart fluid comprising electrorheological fluid, magnetorheological fluid, or both;

one or more coils disposed proximal the smart fluid and coupled to a source of electrical current, such that when an electrical current is provided to the one or more coils, the smart fluid changes from a relatively low-viscosity fluid to a relatively high-viscosity gel, a viscoelastic solid, or a combination thereof;

a housing disposed between the first reservoir and the suction valve and extending longitudinally therebetween;

one or more seals disposed between the housing and the first reservoir;

an actuating rod extending from within the first reservoir and through an aperture defined in the housing, and into the housing, the actuating rod being configured to translate longitudinally with respect to the first reservoir and the housing;

a plunger plate coupled to the actuating rod and being configured to translate longitudinally therewith;

one or more fingers coupled to the plunger plate, extending longitudinally therefrom, and configured to translate longitudinally therewith, the one or more fingers being further configured to be received into one or more ports of the suction valve and to engage one or more valve elements thereof, the one or more valve elements being biased toward a closed position and configured to move toward an open position in the presence of a pressure differential;

a biasing member coupled to the plunger plate and configured to bias the plunger plate toward the one or more valve elements such that the fingers follow the movement of the one or more valve elements;

a pressure balance line extending between the housing and the first reservoir and being configured to communicate the pressure from the housing to the first reservoir; and an infinite step controller communicably coupled to the source of electrical current, the infinite step controller being configured to send electrical current from the source of electrical current to the coils, such that the smart fluid resists the movement of the actuating rod.

19. The apparatus of claim 18, further comprising:

a second reservoir also containing the smart fluid and coupled to a cooling device configured to remove heat from the smart fluid;

a circulation line extending between the first and second reservoirs and including a check valve configured to allow the smart fluid to flow from the first reservoir to the second reservoir, but not from the second reservoir to the first reservoir; and a return line extending between the first and second reservoirs and including an orifice, the return line being configured to allow the smart fluid to flow from the second reservoir to the first reservoir, but not from the first reservoir to the second reservoir.

* * * * *